US007891049B1

(12) United States Patent
Miner

(10) Patent No.: US 7,891,049 B1
(45) Date of Patent: Feb. 22, 2011

(54) DEEP CLEANER WITH HEAT-RETAINING SKIRT

(75) Inventor: Jonathan L. Miner, Rockford, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 947 days.

(21) Appl. No.: 11/539,752

(22) Filed: Oct. 9, 2006

(51) Int. Cl.
*A47L 7/00* (2006.01)

(52) U.S. Cl. ..... 15/353; 15/320

(58) Field of Classification Search ..... 15/353, 15/320, 322, 422
See application file for complete search history.

(56) References Cited

U.S. PATENT DOCUMENTS 5,077,863 A * 1/1992 Rench ..... 15/384
6,481,050 B1 * 11/2002 Wilson et al. ..... 15/413
2006/0288518 A1 12/2006 Lenkiwicz et al.

OTHER PUBLICATIONS

Bissell Homecare, Inc.; Proheat Extractor, Underside of base. On sale more than 1 year prior to Oct. 9, 2005.

* cited by examiner

*Primary Examiner*—Shay L Karls
(74) *Attorney, Agent, or Firm*—McGarry Bair PC

(57) ABSTRACT

An upright extraction cleaning machine for cleaning a surface comprises a base assembly having a housing having at least one side wall and a rear wall extending toward the surface. A source of heated air is enclosed within the base assembly and the heated air is dischargeable through a bottom of the base assembly to the surface. At least one side wall skirt extends from the at least one side wall toward the surface, and a rear wall skirt extends from the rear wall toward the surface. The at least one side wall skirt and the rear wall skirt define an enclosed space beneath the base assembly for retaining heated air discharged from the base assembly against the surface.

9 Claims, 8 Drawing Sheets

DEEP CLEANER WITH HEAT-RETAINING SKIRT

BACKGROUND OF THE INVENTION

1. Field of the Invention

This invention relates to extraction cleaners. In one of its aspects, the invention relates to an upright extraction cleaning machine with enhanced surface cleaning and drying. In another of its aspects, the invention relates to an extraction cleaning machine with a heated cleaning zone.

2. Description of the Related Art

Upright extraction cleaning machines have been used for removing dirt from surfaces such as carpeting and bare floors. The known extraction cleaning machines are frequently in the form of an upright unit, as disclosed in U.S. Provisional Patent Application Ser. No. 60/743,153 of Kasper, et al., filed Jan. 20, 2006, entitled "Upright Extractor." The upright unit typically comprises a wheeled base for travel along the surface to be cleaned and a handle for directing the movement of the base. The base is adapted to selectively apply a heated cleaning and rinsing liquids to the surface.

The cleaning solution is typically heated with an in-line heater or an immersion heater in a cleaning solution tank prior to being deposited on the surface to be cleaned. However, the heated cleaning solution tends to cool during the time that the cleaning solution travels from the heater to the surface to be cleaned. The heating solution is further cooled upon contact with the surface. Additional cooling can take place between the time that the heating solution contacts the surface and the time that the solution and soiled cleaning solution is extracted from the surface. This loss of heat can reduce the effectiveness of the cleaning solution. Heating of the surface can reduce or compensate for the cooling of the heating solution.

Prior art upright extraction cleaning machines exhaust warm working air and motor cooling air downward from the base onto the surface to be cleaned. This warm air typically exhausts from beneath the sides and rear of the base without completely transferring its heat to the surface. This heat currently is not, but could be, used for heating the surface during cleaning and drying operations.

SUMMARY OF THE INVENTION

According to the invention, an upright extraction cleaning machine for cleaning a surface as the upright extraction cleaning machine comprises a base assembly having a housing with at least one side wall and a rear wall extending toward the surface. A source of heated air is enclosed within the base assembly and is ported for discharging heated air through a bottom of the base assembly to the surface. At least one side wall skirt extends from the at least one side wall toward the surface, and a rear wall skirt extends from the rear wall toward the surface. The at least one side wall skirt and the rear wall skirt define an enclosed space beneath the base assembly for retaining heated air discharged from the base assembly against the surface.

DESCRIPTION OF AN EMBODIMENT OF THE INVENTION

Figure 1:
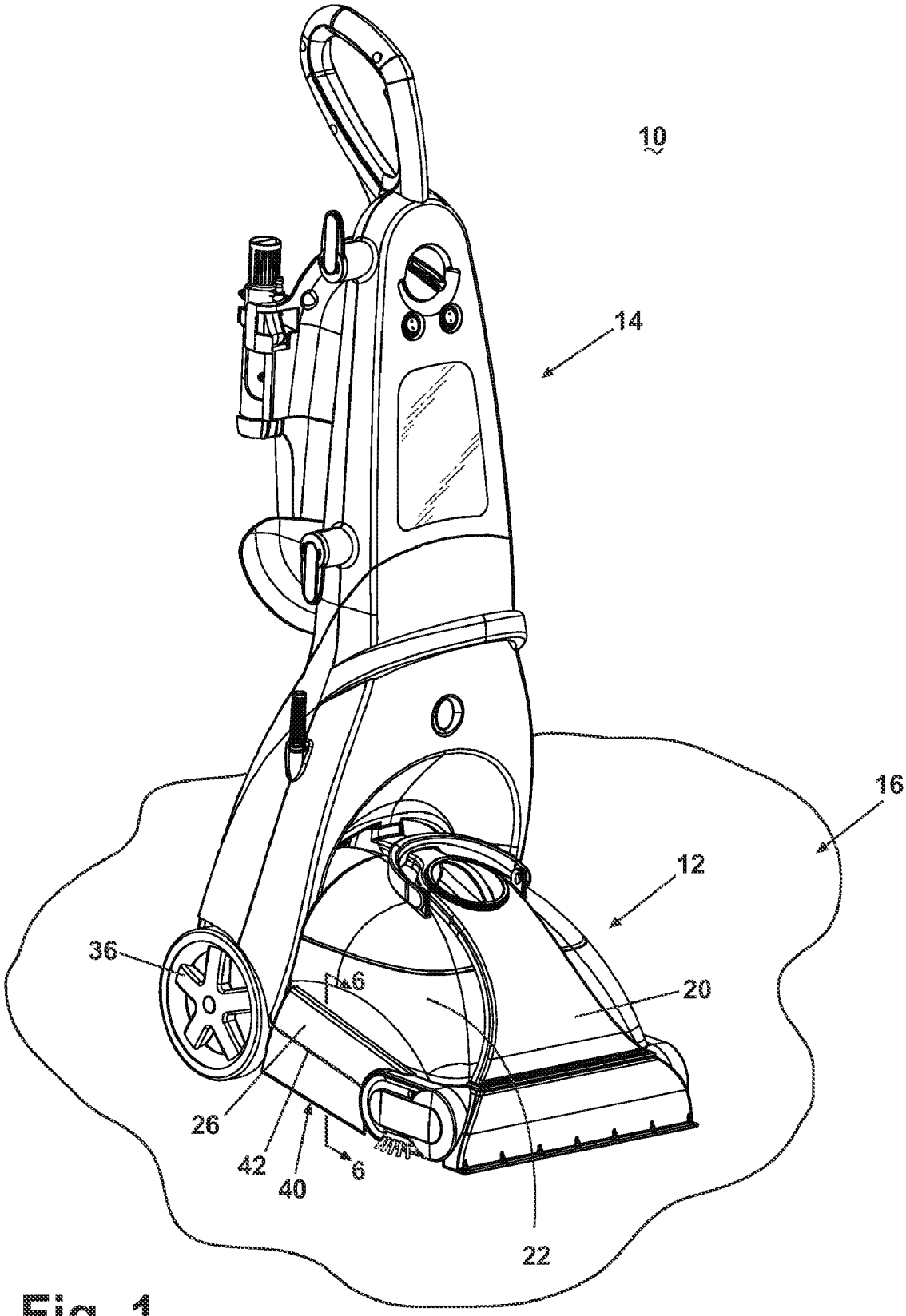
FIG. 1 is a side elevational view of an embodiment of an upright extraction cleaning machine comprising a base assembly with a side wall heat-retaining skirt according to the invention.
Figure 2:
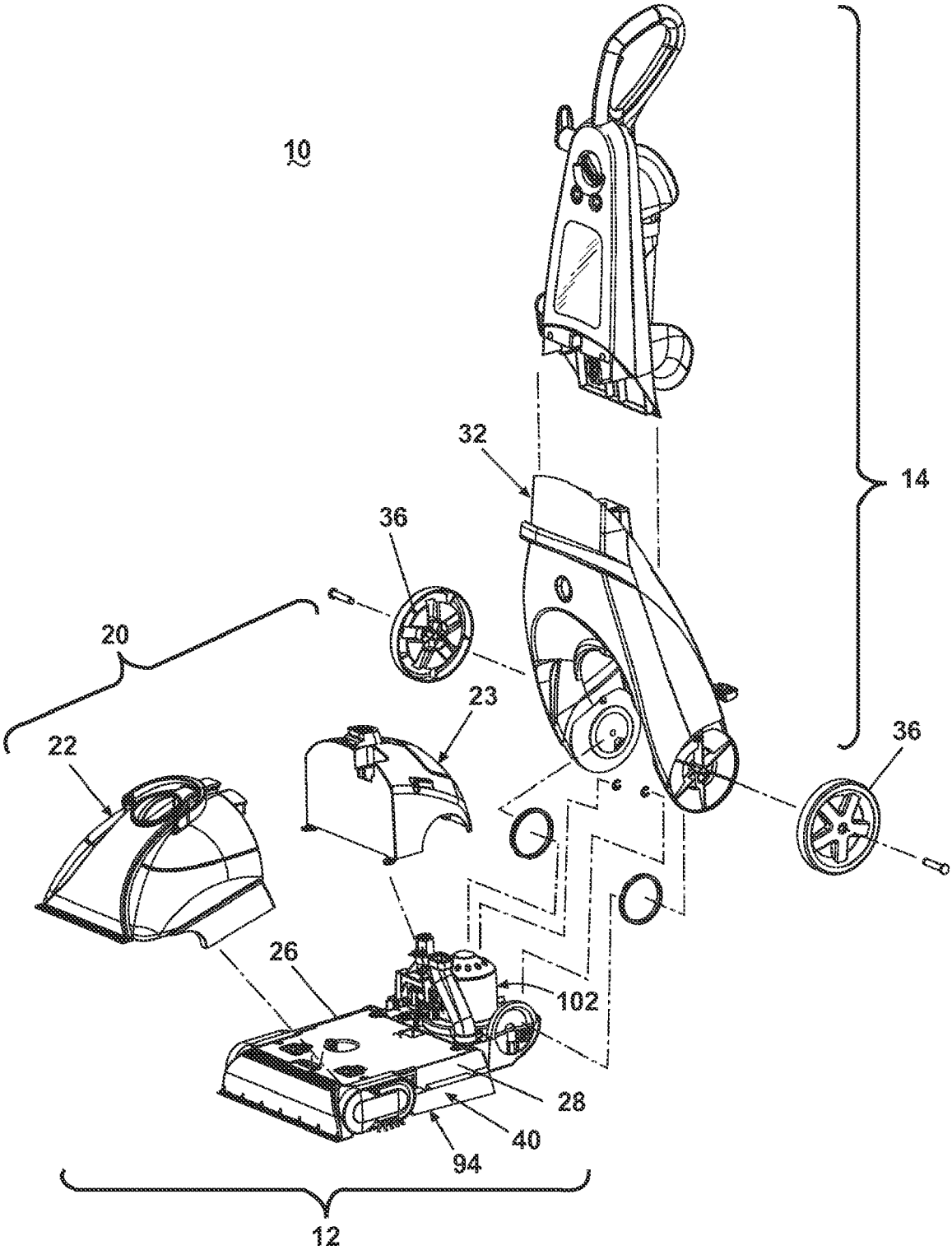
FIG. 2 is an exploded view of the base assembly illustrated in FIG. 1.

Referring to the drawings, and specifically to FIG. 1, an embodiment of an upright extraction cleaning machine 10 according to the invention is illustrated. The extraction cleaning machine 10 comprises a foot assembly 12 adapted for travel along a surface to be cleaned 16, such as a carpet, and a handle assembly 14 pivotally attached thereto for directing the movement of the foot assembly 12 along the surface. The extraction cleaning machine 10 shares many features of well-known upright extraction cleaning machines, including, with reference also to FIG. 2, a housing 20 enclosing a motor and fan assembly 102, a liquid distribution system (not shown), a recovery tank assembly 21, a solution supply tank assembly 23, and a rotating brush drive system (not shown), which will not be described in detail herein except as necessary for a complete understanding of the invention. Such an upright extraction cleaning machine is described and illustrated in U.S. Provisional Patent Application Ser. No. 60/743,153 of Kasper, et al., filed Jan. 20, 2006, entitled "Upright Extractor," which is incorporated by reference herein by reference in its entirety.

The foot assembly 12 comprises a housing 20 having a front wall 22, a rear wall 24, and a pair of sidewalls 26, 28 (See, FIG. 7) extending between the front wall 22 and the rear wall 24. The housing can be defined in part by the recovery tank assembly 21 and the solution supply tank assembly 23. Only one sidewall 26 is illustrated in FIG. 1. Both sidewalls are identical; thus, the invention will generally be described with reference to only the sidewall 26. The sidewalls 26, 28 terminate somewhat above the surface 16 when the extraction cleaning machine 10 is supported on the surface 16, such as the side wall edge 30 illustrated in FIG. 1. The foot assembly 12 is supported upon the surface 12 by a pair of opposed wheels adjacent the side walls 26, 28, such as the wheels 36 illustrated in FIGS. 1, 2, and 7.

The foot assembly 12 also comprises a suction nozzle 34 at a forward portion of the foot assembly 12 which opens downwardly toward the surface 16 for extracting soiled cleaning fluid from the surface 16.

Figure 3:
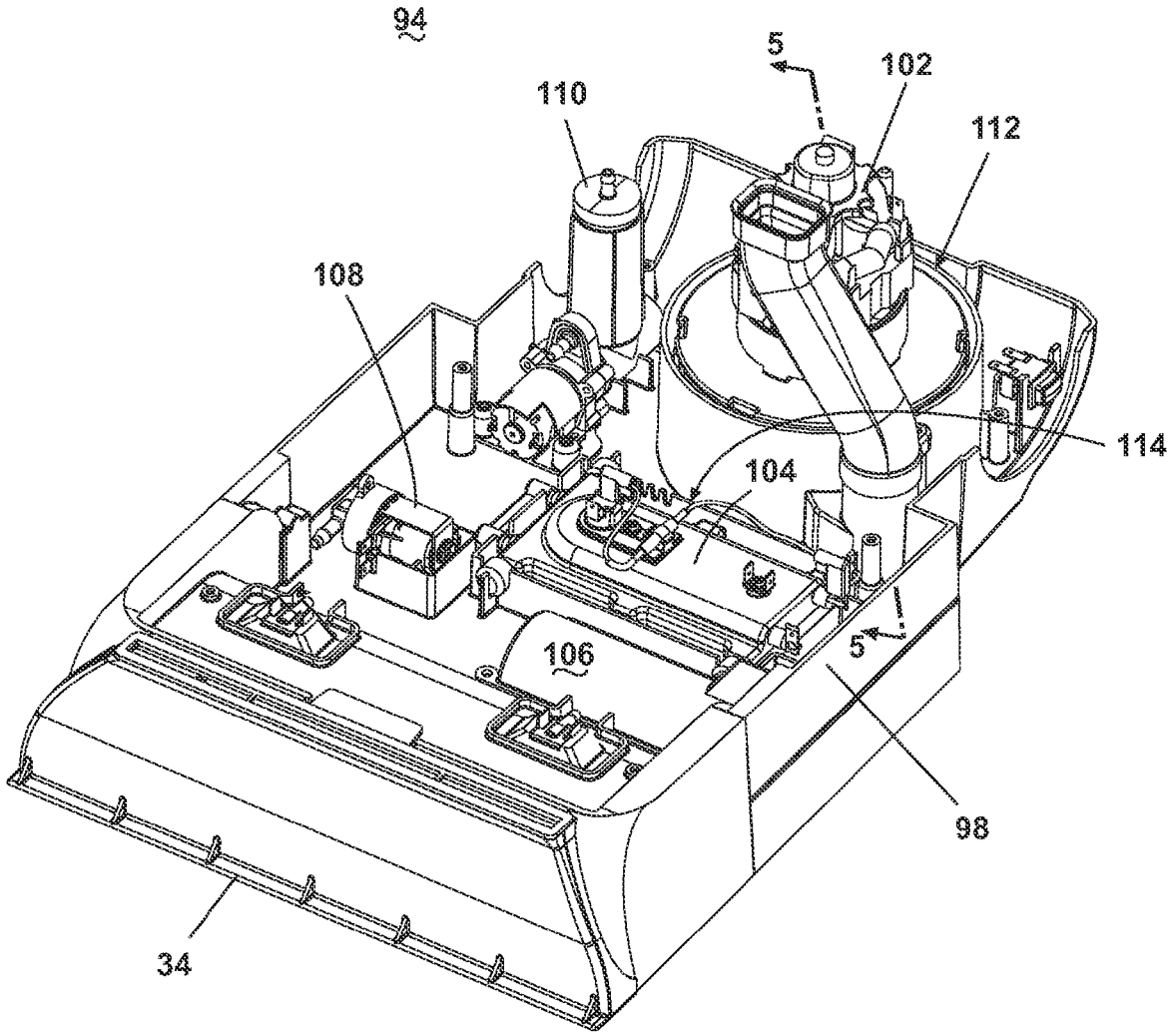
FIG. 3 is a perspective view from above of the base assembly illustrated in FIG. 2 with portions removed to show selected interior components thereof, including a motor and fan assembly.

The foot assembly 12 can comprise a base assembly 94 beneath and supporting the recovery tank assembly 21 and the solution supply tank assembly 23. As illustrated in FIG. 3, the base assembly 94 comprises a lower base housing portion 98 having structures extending upwardly from the bottom thereof adapted to support various well-known components of the foot assembly 12, such as a motor and fan assembly housing 112 for supporting a motor and fan assembly 102, a heater support 114 for supporting a heater 104, and other structures for supporting an agitator motor 106, spray tip valves, 108, a pump assembly 110, and the like.

Figure 4:
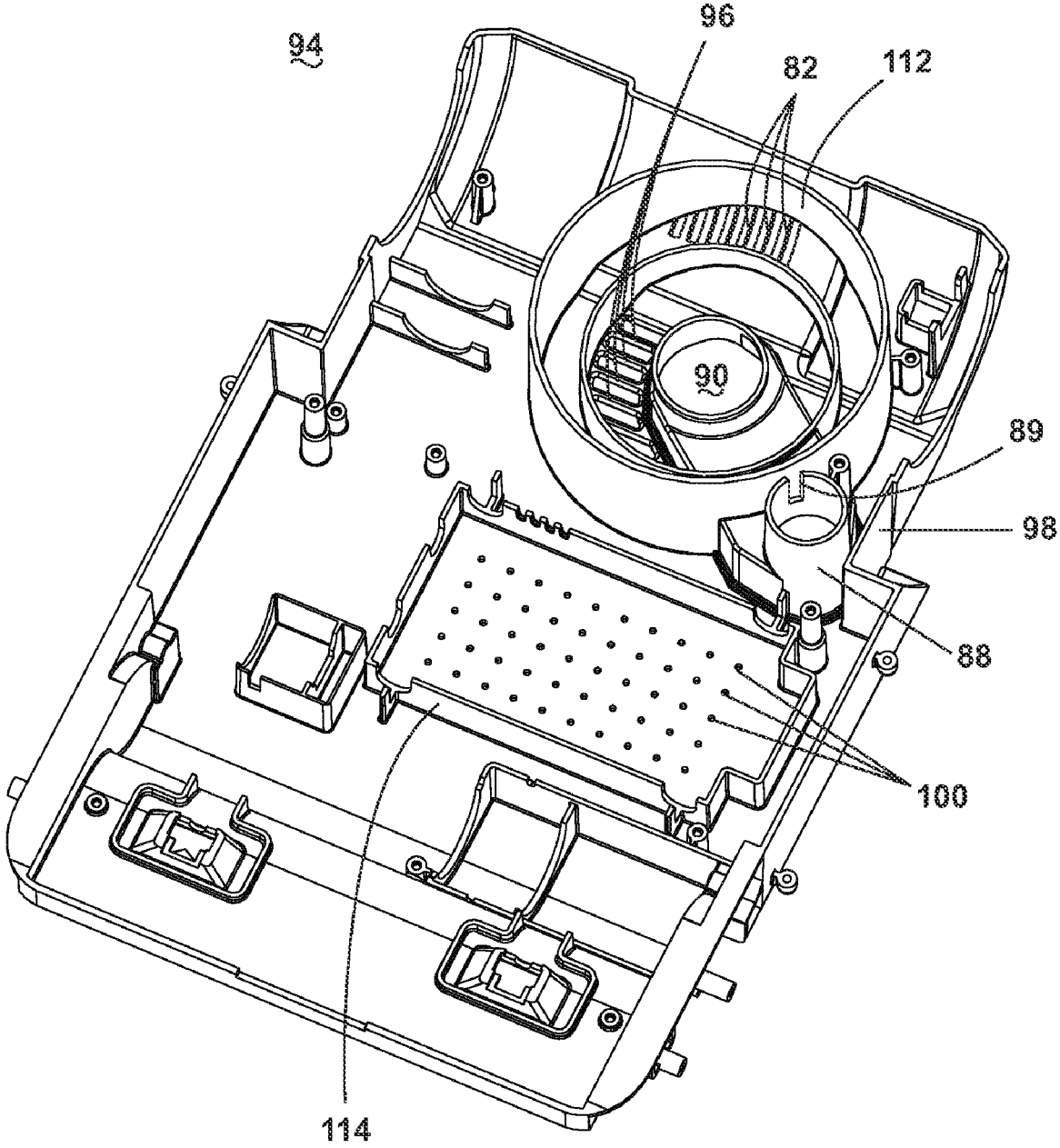
FIG. 4 is an alternate perspective view from above of the base assembly illustrated in FIG. 3 with the selected interior components removed to show air vents extending through the bottom of the base assembly.

As illustrated in FIG. 4, a part of the lower base housing portion 98 associated with the heater support 114 can comprise an array of heater vent openings 100 to vent excess heat from the heater 104 out of the base assembly 94 and against the surface 16. If desired, a fan (not shown) can be provided in the base housing portion 98 proximate to the heater 104 to blow cooling air around the heater 104 and out through the vent openings 100. An array of working air exhaust vents 96 can be provided in the lower base housing portion 98 associated with the motor and fan assembly housing 112 to direct working air from the motor and fan assembly 102 out of the base assembly 94 against the surface 16. Similar vents (not shown) can be incorporated into the lower base housing portion 98 to direct heated air from other heat-generating components, such as the agitator motor 106, out of the base assembly 94 against the surface 16. Suitable cooling for motors is well known and is disclosed, for example, in the U.S. Pat. No. 6,481,050 to Wilson, wherein the heated cooling air from a motor is vented to the underside of the lower housing portion 98 through suitable vent openings. Thus, the vents 96, 100 serve two purposes: 1) prevent overheating of the components, and 2) direct heated air toward the surface to be cleaned.

Figure 5:
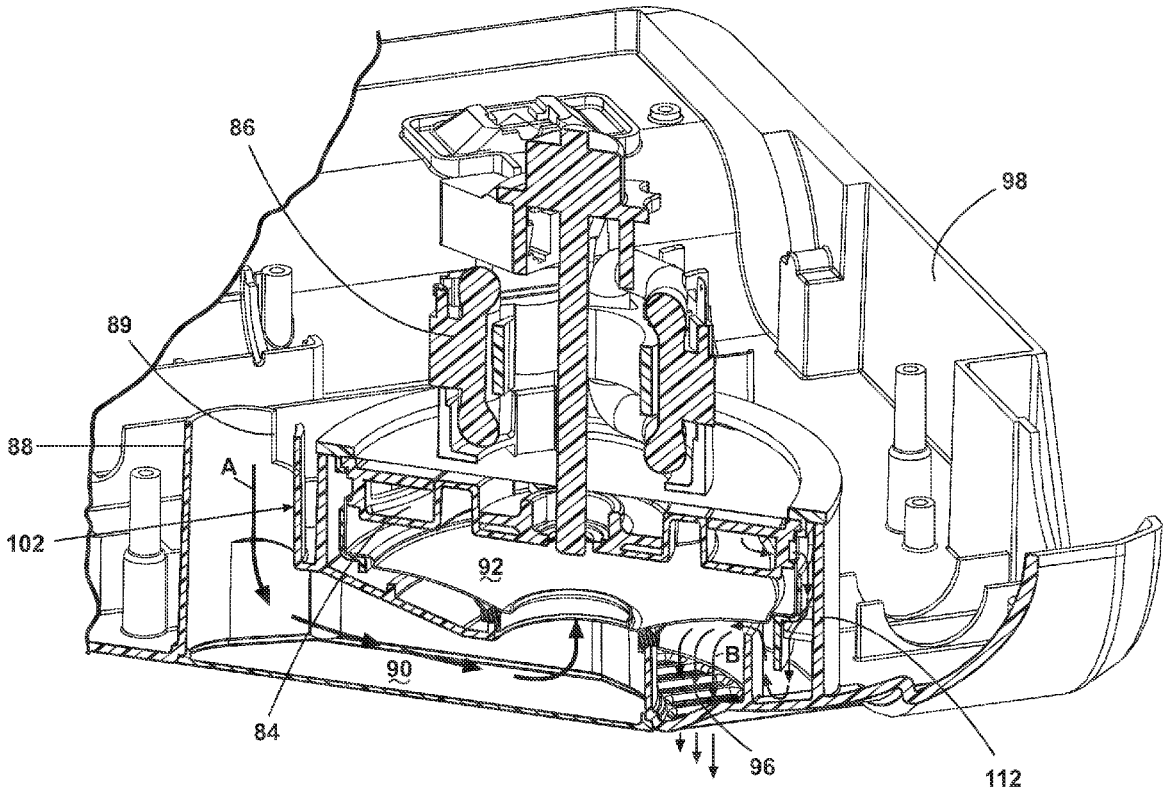
FIG. 5 is a partial sectional view of the base assembly illustrated in FIG. 3 showing air flow through the motor and fan assembly and exiting the air vents.

Referring also to FIG. 5, the lower base housing portion 98 is provided with a motor and fan assembly inlet conduit 88 adapted for fluid communication with the recovery tank assembly 21 and the suction nozzle 34 to define a well-known suction pathway from the suction nozzle 34, through the recovery tank assembly 21, into the motor and fan assembly 102, and exiting the base assembly 94 through the working air exhaust vents 96. The motor and fan assembly 102 comprises a motor 86 and an impeller 84, wherein the motor 86 drives the impeller 84 to create the working air flow through the extraction cleaning machine 10. The motor and fan assembly inlet conduit 88 transitions into a channelway 90 that extends into a lower portion of the motor and fan assembly housing 112 beneath the impeller 84. The impeller 84 is adapted to draw air into an impeller chamber 92 through an axial opening from the channelway 90, as illustrated by the airflow vectors "A", and expel air radially outwardly along the perimeter of the motor and fan assembly housing 112 to the working air exhaust vents 96, as illustrated by the airflow vectors "B." The motor 86 can be cooled by drawing cooling air into the lower base portion 98 through suitable vents 82 (FIG. 7) and over the motor by a suitable cooling fan (not shown) driven my the motor 86 (as, for example, disclosed in the Wilson et al. U.S. Pat. No. 6,481,050), and then ported either to the working air conduit through inlet vent 89 or directly into the impeller chamber 92.

Figure 6:
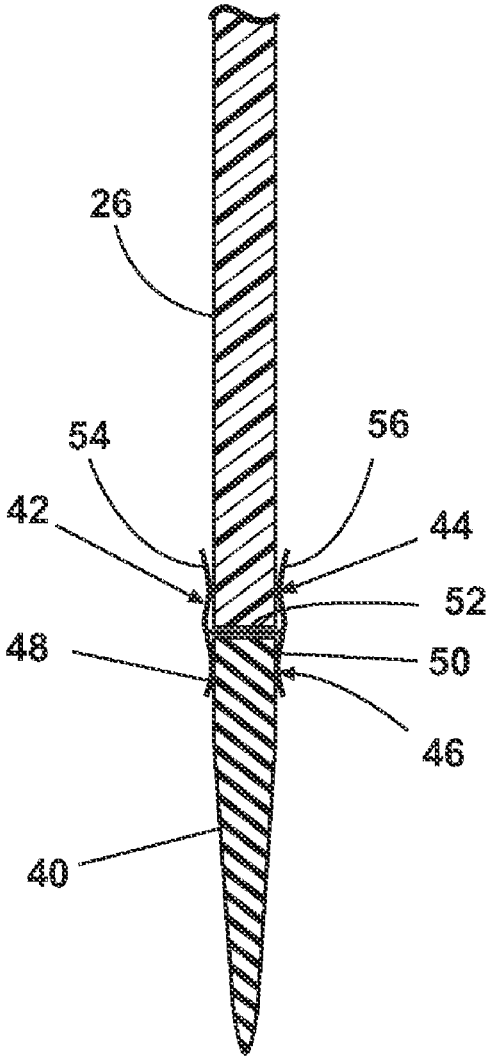
FIG. 6 is a sectional view of a side portion of the upright extraction cleaning machine illustrated in FIG. 1 taken along view line 6-6 of FIG. 1.

As illustrated also in FIG. 6, a side wall skirt 40 is a flat, elongated, generally bladelike member having a thickness complementary to the thickness of the side walls 26, 28. The side wall skirt 40 is illustrated as having a somewhat knife-blade-like cross-section, although the cross-section can have another suitable configuration such as rectangular. The side wall skirt 40 is adapted with a connector, such as a clip 42, for attaching the side wall skirt 40 to the side wall 26, 28. The clip 42 is illustrated in FIG. 6 as comprising an upper portion 44 and a lower portion 46. The lower portion 46 comprises a pair of opposed sidewalls 48, 50 joined by a top wall 52 to form a somewhat U-shaped channel adapted for fixedly holding the side wall skirt 40. The upper portion 44 comprises a pair of opposed spring fingers 54, 56 extending from the top wall 52 to form a somewhat U-shaped channel adapted for gripping the side walls 26, 28. Alternatively, the clip 42 can be fixedly attached to one or both of the side wall skirt 40 and the side wall 26, 28 through an adhesive, fasteners such as rivets, and the like. However, the use of a clip 42 enables the selective removal of the side wall skirt 40 from the side wall 26, 28 as desired. Additionally, a single clip 42 can be utilized extending the full length of the side wall skirt 40, or a plurality of clips can be used spaced along the full length of the side wall skirt 40.

The side wall skirt 40 is adapted to extend from the sidewall edge 30 to or somewhat above the surface 16 when attached to the side wall 26, 28. Preferably, the side wall skirt 40 extends longitudinally along the side wall 26, 28 from the suction nozzle 34 to the rear wall 24 of the housing 20. The length and height of the side wall skirt 40 can be selected for control of air flow and the retention of heat beneath the foot assembly 12.

Figure 7:
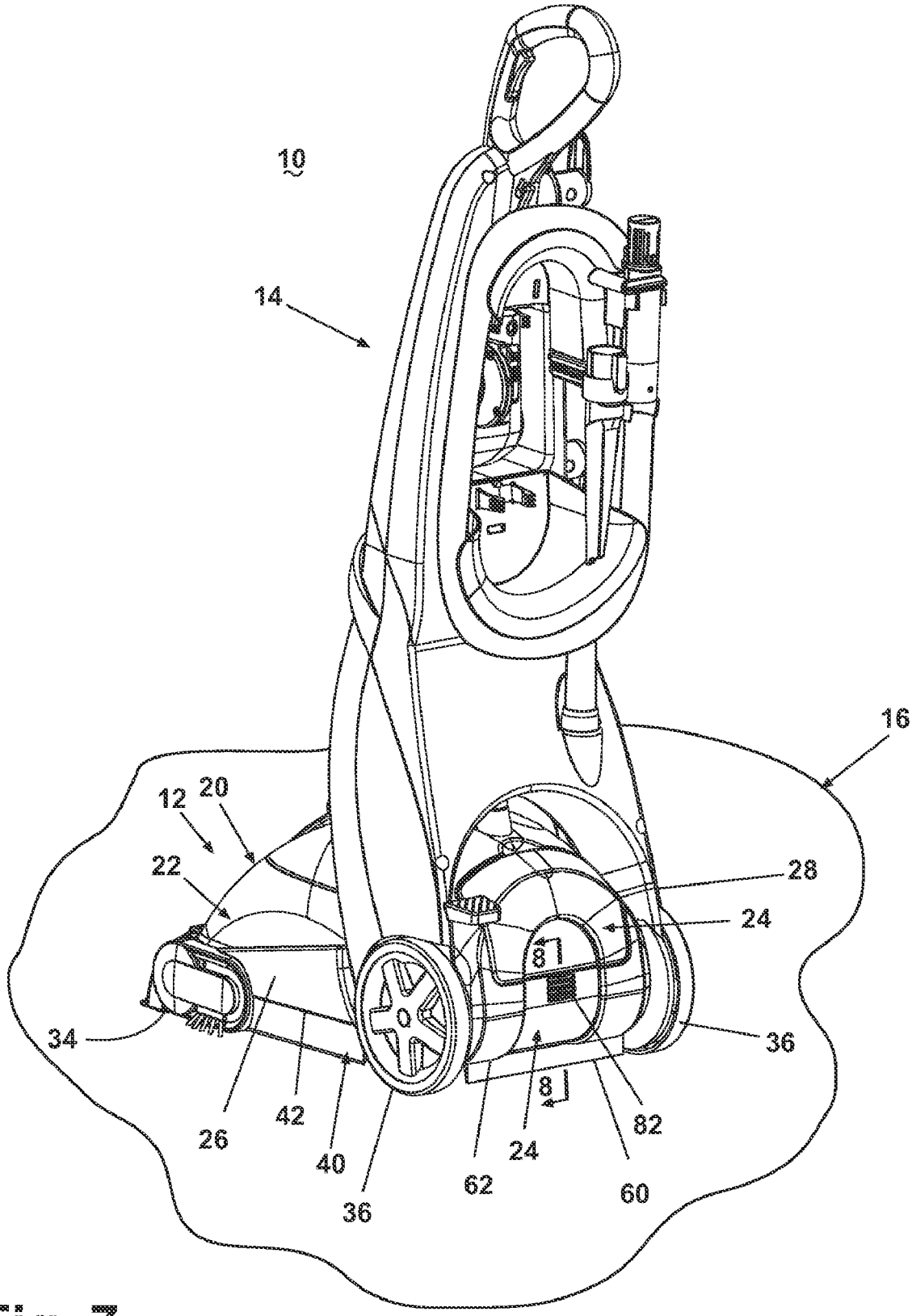
FIG. 7 is a rear perspective view of the upright extraction cleaning machine of FIG. 1 illustrating a rear wall heat-retaining skirt according to the invention.
Figure 8:
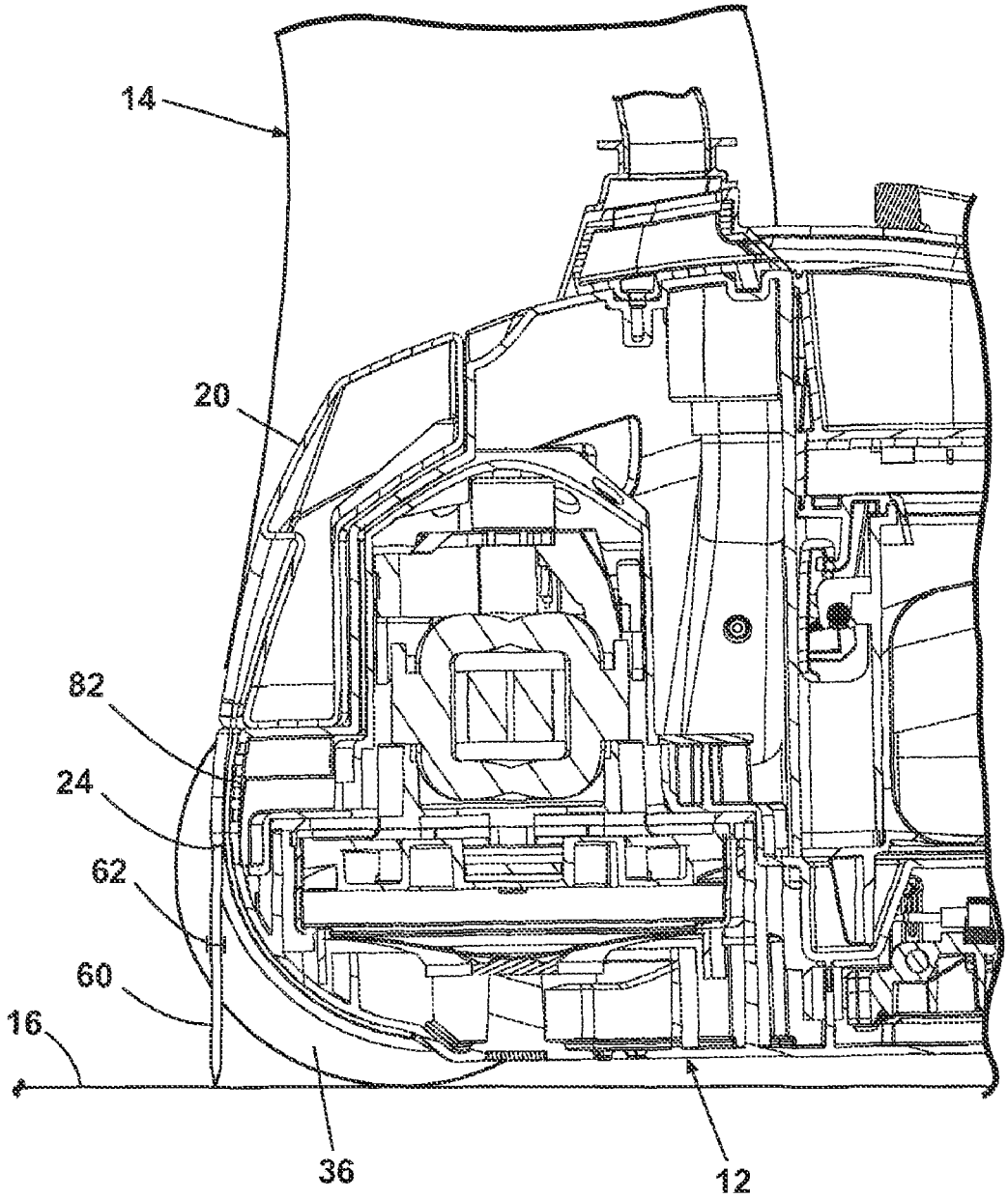
FIG. 8 is a sectional view of a rear portion of the upright extraction cleaning machine taken along view line 8-8 of FIG. 7.

Referring now to FIGS. 7 and 8, a rear wall skirt 60 is a flat, elongated, generally bladelike member similar in configuration to the side wall skirt 40 and adapted to extend across the rear of the housing 20 to or somewhat above the surface 16 when attached to the rear wall 24 of the housing 20. The rear wall skirt 60 is preferably attached to the rear wall 24 through a pivot connection 62 such as a hinge, to enable the rear wall skirt 60 to pivot freely and thereby avoid interference with the movement of the extraction cleaning machine 10 along the surface 16. Alternatively, the rear wall skirt 60 can comprise a flexible material which is attached to the rear wall 24 in a manner similar to that described for the side wall skirt 40. The flexibility of the rear wall skirt 60 can be selected to provide a reduced interference of the rear wall skirt 60 with the movement of the extraction cleaning machine 10 along the surface 16.

The use of the side wall skirt 40 and rear wall skirt 60 provide an enclosed area beneath the foot assembly 12 which will hold heated air discharged through the air exhaust grille 100 against the surface 16, thereby heating the surface 16 and enhancing the cleaning action of the extraction cleaning machine 10. The retention of heated air in an enclosed area beneath the foot assembly 12 also facilitates drying of the surface 16 after the cleaning and rinsing operations have been completed.

Figure 9:
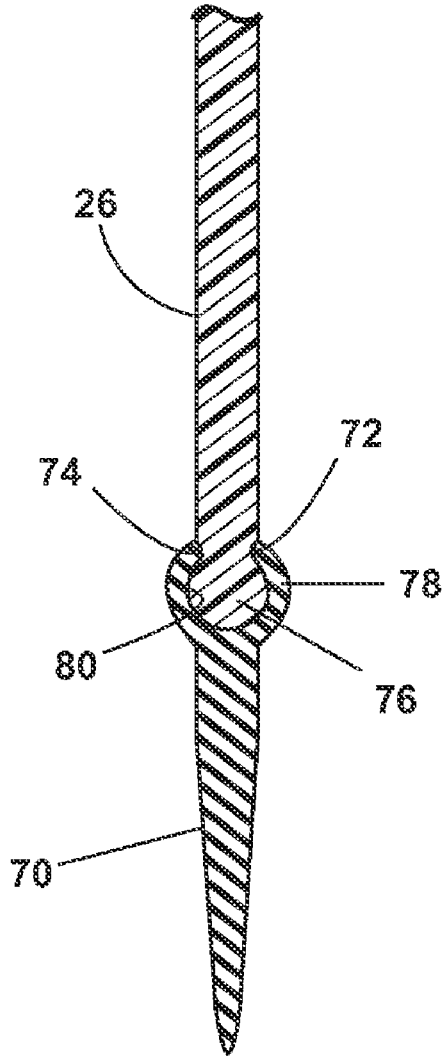
FIG. 9 is a sectional view of a side portion of the upright extraction cleaning machine illustrated in FIG. 1 taken along view line 6-6 showing an alternate embodiment of a side wall heat-retaining skirt according to the invention.

FIG. 9 illustrates an alternate embodiment of the side wall skirt 70 which is similar to the side wall skirt 40. However, the edge of the side wall skirt 70 adjacent the side wall 26 comprises a semi annular portion 78 defining a circular channelway 80. The side wall 26 comprises a pair of opposed channelways 72, 74 extending the length of the side wall 26 so that the edge of the side wall 26 terminates in a generally cylindrical rail 76. The semi-annular portion 78 and rail 76 are adapted so that the rail 76 is received within the channelway 80 in snap-fit registry to fixedly attach the side wall skirt 70 to the side wall 26.

It will be evident to one of ordinary skill in the art that other means of fixedly attaching the side wall skirt 40 and the rear wall skirt 60 to the housing 20, such as adhesives, rivets, welding, and the like, can be employed.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An upright extraction cleaning machine for cleaning a surface as the upright extraction cleaning machine is moved along the surface, the extraction cleaning machine comprising:

a base assembly comprising a housing having at least one side wall extending toward the surface, a rear wall extending toward the surface and a bottom wall;

a suction nozzle at a forward portion of the base assembly;

a source of heated air enclosed within the base assembly, a port located rearwardly of the suction nozzle in the bottom wall in fluid communication with the source of heated air for exhausting heated air through a bottom of the base assembly to the surface;

at least one side wall skirt positioned entirely rearwardly of the suction nozzle and extending from the at least one side wall toward the surface; and a rear wall skirt extending from the rear wall toward the surface;

wherein the at least one side wall skirt and the rear wall skirt define an enclosed space rearwardly of the suction nozzle beneath the base assembly for retaining heated air exhausted from the port against the surface.

2. The upright extraction cleaning machine according to claim 1 wherein the skirts are removably mounted onto the at least one side wall and rear wall.

3. The upright extraction cleaning machine according to claim 2 wherein the skirts are flexible.

4. The upright extraction cleaning machine according to claim 1 wherein the source of heated air comprises at least one of a heater and a motor.

5. The upright extraction cleaning machine according to claim 4 wherein the source of heated air comprises both a heater and a motor.

6. The upright extraction cleaning machine according to claim 1 wherein the port comprises multiple vents.

7. The upright extraction cleaning machine according to claim 1 wherein the at least one side wall skirt further extends along the at least one side wall at least a portion of the distance between the suction nozzle and the rear wall and adjacent to the port in the bottom wall.

8. The upright extraction cleaning machine according to claim 1 wherein the at least one side wall comprises two side walls, one on each side of the housing, and the at least one side wall skirt comprises two side wall skirts, one extending along each of the two side walls at least a portion of the distance between the suction nozzle and the rear wall.

9. The upright extraction cleaning machine according to claim 8 wherein the rear wall skirt extends across the rear wall.

* * * * *